United States Patent [19]

Kiyota

[11] 4,125,098

[45] Nov. 14, 1978

[54] MULTICYLINDER ENGINE

[75] Inventor: Yuhiko Kiyota, Nagaokakyo, Japan

[73] Assignee: Mitsubishi Jidosha Kogyo Kabushiki Kaisha, Japan

[21] Appl. No.: 697,124

[22] Filed: Jun. 17, 1976

[30] Foreign Application Priority Data

Jun. 24, 1975 [JP] Japan ..... 50/78132

[51] Int. Cl.[2] ..... F02M 7/00; F02M 13/06

[52] U.S. Cl. ..... 123/119 LR; 123/127; 60/276

[58] Field of Search ..... 123/127, 119 LR; 60/276, 285, 274

[56] References Cited

U.S. PATENT DOCUMENTS

| | | | |
|---|---|---|---|
| 3,648,674 | 3/1972 | Proctor | 123/127 |
| 3,678,911 | 7/1972 | Soubis | 123/127 |
| 3,708,980 | 1/1973 | Truxell | 60/274 |
| 3,785,153 | 1/1974 | Schwing | 60/276 |
| 3,910,241 | 10/1975 | Fijisawa | 60/276 |

*Primary Examiner*—Ronald B. Cox

*Attorney, Agent, or Firm*—Robert E. Burns; Emmanuel J. Lobato; Bruce L. Adams

[57] ABSTRACT

A multicylinder engine comprising at least one first cylinder, a corresponding number of second cylinder, and a carburetor to supply a fuel-air mixture leaner than stoichiometric to all the first and second cylinders. When required by the driving range and other driving conditions, a rich mixture is supplied to the second cylinder to lower the air-fuel ratio in it for the purpose of exhaust emission purification, while the first cylinder is being supplied with the lean mixture.

3 Claims, 3 Drawing Figures

MULTICYLINDER ENGINE

DETAILED DESCRIPTION OF THE INVENTION

This invention relates to an engine having a cylinder to which a rich fuel-air mixture is supplied (hereafter called the R-cylinder) and a cylinder to which a lean fuel-air mixture is supplied (hereafter called the L-cylinder).

Generally, an automotive engine is so designed as to make the ratios of air to fuel (hereafter called the air-fuel ratio) in all cylinders as uniform as possible. At partial load, such engine consumes the least quantity of fuel, but gives forth much NOx in exhaust emissions. At high load when the throttle is substantially fully opened, a rich mixture, with a low air-fuel ratio, must be supplied to maintain high power output, and exhaust emissions contain plenty of unburned CO and HC. At light load, or when the engine rotates at low speed, the mixture does not burn perfectly because of the cold cylinder walls and other reasons, and noxious emissions containing large quantities of unburned CO and HC are discharged.

As is popularly known, CO and HC concentrations in exhaust gases can be reduced by efficiently burning the mixture under high temperature, supplying enough air. But NOx increases with increasing combustion temperature. Therefore combustion temperature must be lowered to decrease NOx emission.

That is, ordinary internal combustion engines have the following three emission characteristics:

(1) With a rich and a lean fuel-air mixture, NOx concentration is low.

(2) With a rich mixture, CO and HC concentrations are high.

(3) With a lean mixture, CO and HC concentrations are low, and oxygen concentration high, if there occurs no misfire.

Taking advantage of these three characteristics, the inventor proposed a multicylinder internal combustion engine which can effectively reduce HC, CO and NOx emissions by recombusting or reoxidizing unburned HC and CO in the exhaust gases with the oxygen contained in the fuel-air mixture, supplying little or no emission-purifying secondary air. This invention relates to an improved multicylinder engine of the aforesaid type, wherein rich-mixture and lean-mixture cylinders all communicate with a single carburetor through a single intake manifold, comprising means for supplying a rich fuel-air mixture or fuel, which is integral with the aforesaid carburetor to prepare a lean fuel-air mixture, and a passage for connecting said supplying means to the rich-mixture branch of said intake manifold communicating with the rich-mixture cylinder.

Now a preferred embodiment of this invention will be described with reference to the accompanying drawings, in which.

Figure 1:
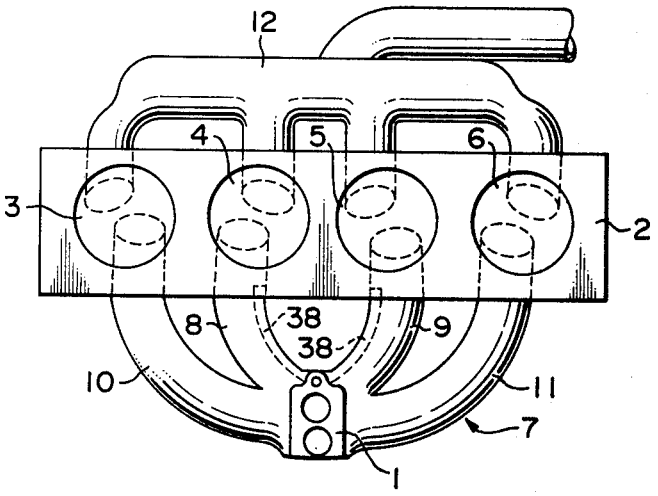
FIG. 1 is a schematic illustration of an embodiment of this invention.
Figure 2:
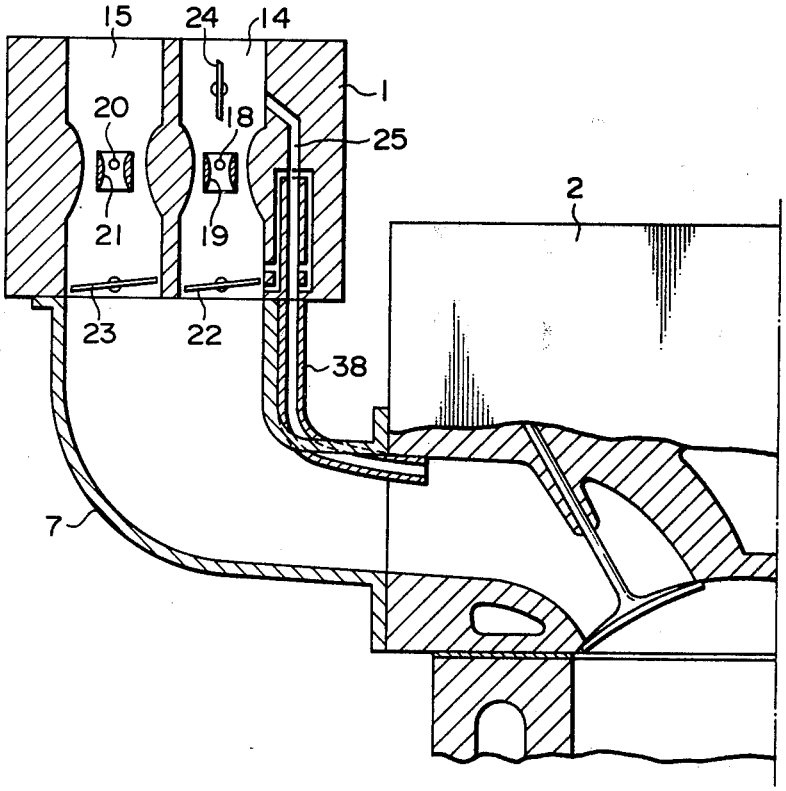
FIG. 2 is a partial cross-section of FIG. 1.

In this embodiment, the rich-mixture supplying means is integral with the carburetor having a first and a second slow-jet system. This carburetor supplies a lean fuel-air mixture prepared in its main section and first slow-jet system to all cylinders. A rich fuel-air mixture prepared in the second slow-jet system is fed to the R-cylinder branch of the intake manifold communicating with the R-cylinder.

In the drawings, item 1 denotes a carburetor connected to an intake manifold 7 communicating with first to fourth cylinders 3, 4, 5 and 6 of an engine 2. The intake manifold 7 has branches 8 and 9 leading to the R-cylinders 4 and 5 and branches 10 and 11 leading to the L-cylinders 3 and 6. Item 12 is an exhaust manifold serving as a thermal reactor to recombust exhaust gases discharged from the cylinders 3, 4, 5 and 6.

Reference numeral 13 designates means for supplying a rich fuel-air mixture which is integrally provided with the carburetor 1. In this embodiment, a second slow-jet system usually provided in the carburetor is used as that means. This carburetor 1 has a lean mixture supplying system comprising a primary mixture passage 14, a secondary mixture passage 15, and a first slow-jet system 16. It also has a second slow-jet system 17 serving as the rich mixture supplying means 13. Item 18 is a primary main nozzle provided in a venturi 19 formed in the primary mixture passage 14, item 20 a secondary main nozzle in a venturi 21 formed in the secondary mixture passage 15, item 22 a primary throttle valve, item 23 a secondary throttle valve, and item 24 a choke valve.

Figure 3:
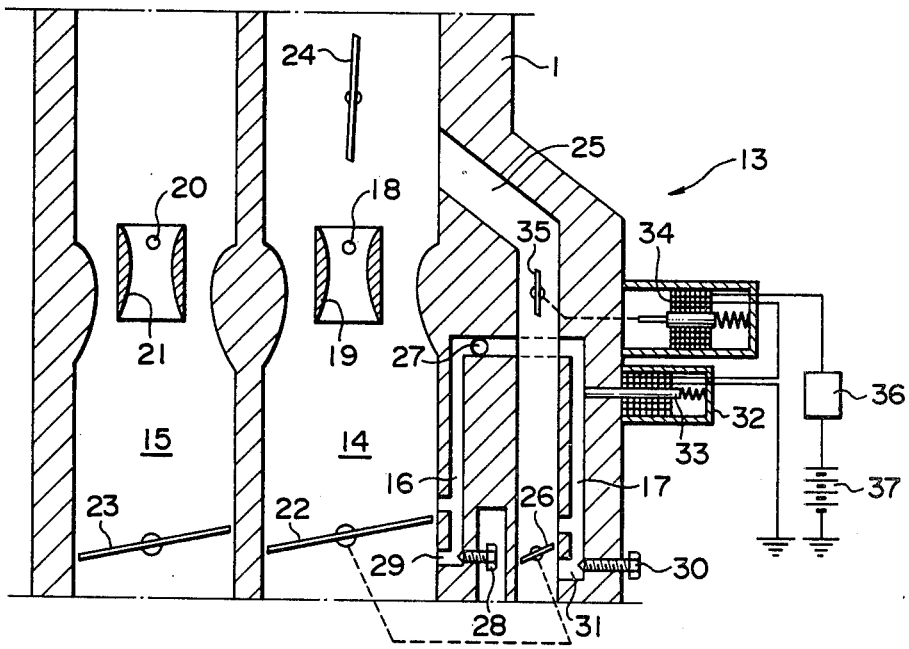
FIG. 3 is a partly enlarged view of the carburetor in FIG. 2.

Item 25 is a rich mixture forming passage, item 26 a throttle valve disposed in the passage 25, item 27 a slow-jet fuel supply port to supply fuel from a float chamber, not shown, to the first and second slow-jet systems 16 and 17, item 28 a pilot screw fitted into a slow-jet port 29 of the first slow-jet system, and item 30 a pilot screw fitted into a slow-jet port 31 of the second slow-jet system 17. The throttle valve 26 is interlocked with the throttle valve 22 as indicated by a broken line in FIG. 3. Reference numeral 32 denotes a solenoid to actuate a needle valve 33 for opening and closing the second throttle system 17, and reference numeral 34 a solenoid to actuate a butterfly valve 35 for opening and closing the rich mixture forming passage 25. The solenoids 32 and 34 are connected in series, and connected, as required, to a power supply 37 through a control circuit 36 to operate simultaneously.

This control circuit 36 is constructed in such a way, for instance, as to detect overheating of cooling water temperature with a thermo-sensor. When the needle valve 33 and butterfly valve 35 are closed by the simultaneous operation of the solenoids 32 and 34, the carburetor 1 makes and supplies only a lean fuel-air mixture with the air-fuel ratio of, for example, 18 to 20 to the cylinders 3, 4, 5 and 6. Meanwhile, when the needle valve 33 and butterfly valve 35 are opened by simultaneously operating the solenoids 32 and 34, the lean mixture with the air-fuel ratio of 18 to 20 is supplied to the L-cylinders 3 and 6, while the R-cylinders 4 and 5 are fed with a rich mixture with the air-fuel ratio of 12 to 13, which is prepared by adding a richer mixture, formed by the rich mixture supplying means 13, to the lean mixture.

Item 38 is an intercommunicating passage to supply said richer mixture to the R-cylinders 4 and 5, opening in the branches 8 and 9, or intake ports, leading to the R-cylinders.

Being so constructed, the lean mixture supplying system of this carburetor 1, comprising the primary mixture passage 14, the secondary mixture passage 15 and the first slow-jet system 16, always supplies the lean fuel-air mixture to all cylinders. The rich mixture supplying means 13, comprising the second slow-jet system 17, supplies the rich mixture only to the R-cylinders, which is prepared by adding the richer mixture to the lean mixture. When the cooling water temperature rises due to engine overheat, the solenoids 32 and 34 are operated through the control circuit 36 to close the second slow-jet port 17 and the rich mixture forming passage 25 to stop the supply of the rich fuel-air mixture. Then, only the lean mixture is fed to all cylinders 3, 4, 5 and 6, which effectively lowers combustion temperature and prevents further overheating.

By supplying rich fuel-air mixture to the R-cylinders and lean mixture to the L-cylinders, this embodiment can effectively reduce NOx, HC and CO emissions. Integral provision of the rich mixture supplying means with the carburetor makes this engine easy to manufacture, and facilitates adjustment of the air-fuel ratios for the R- and L-cylinders. Besides, when overheating occurs, this engine can prevent its progress by feeding only lean mixture to all cylinders 3, 4, 5 and 6.

What is claimed is:

1. A multicylinder engine which comprises at least a first cylinder and a second cylinder; a carburetor for supplying a fuel-air mixture leaner than stoichimetric; means defining a first passage connecting said carburetor with said first and second cylinders for flowing said mixture leaner than stoichiometric from said carburetor to said first and second cylinders; rich mixture supplying means for supplying a fuel-air mixture richer than stoichiometric, integral with said carburetor; and means defining a second passage connecting said rich mixture supplying means with said second cylinder for flowing said mixture richer than stoichiometric to said second cylinder; wherein said carburetor includes a primary mixture passage open at one end to the atmosphere for receiving air, and a venturi having a primary fuel nozzle disposed within said primary mixture passage for mixing air flowing through said primary mixture passage with fuel flowing from said primary fuel nozzle; and wherein said rich mixture supplying means includes a rich mixture forming passage opening in said primary mixing passage to the atmosphere upstream of the carburetor venturi, a throttle valve positioned in said rich mixture forming passage to regulate the mixture flow rate therein, a fuel supply passage opening into said rich mixture forming passage at least downstream of said throttle valve, a first valve disposed upstream of said throttle valve for closing said rich mixture forming passage upstream of said throttle valve, a second valve for closing said fuel supply passage, and valve control means for simultaneously opening and closing both said first and second valves at predetermined temperatures.

2. A multicylinder engine as set forth in claim 1, wherein said carburetor further comprises a throttle valve in said primary mixture forming passage to control the flow rate of the lean mixture from said carburetor; and means for interlocking said throttle valve in said primary mixture forming passage with said throttle valve in the rich mixture forming passage.

3. A multicylinder engine as set forth in claim 1, wherein said valve control means includes first and second solenoids connected to said first and second valves; a switch responsive to engine cooling water temperature; and means connecting said first and second solenoids and said switch in series to form a control circuit in which both said solenoids operate according to the cooling water temperature.

* * * * *